United States Patent [19]

Yacura

[11] 4,083,119

[45] Apr. 11, 1978

[54] ROLLER DRYER FOR CLAY PIPE

[75] Inventor: Stephen B. Yacura, Glenshaw, Pa.

[73] Assignee: Pullman Incorporated, Pullman Swindell Division, Pittsburgh, Pa.

[21] Appl. No.: 653,769

[22] Filed: Jan. 30, 1976

[51] Int. Cl.[2] ..... F26B 25/00

[52] U.S. Cl. ..... 34/105; 34/236; 104/172 R; 432/246

[58] Field of Search ..... 34/21, 105, 201-204, 34/215-217, 224, 225, 236, 240; 214/18 R; 432/246; 104/172 R; 266/277

[56] References Cited

U.S. PATENT DOCUMENTS

| | | | |
|---|---|---|---|
| 2,481,130 | 9/1949 | Lindemuth | 34/105 |
| 2,751,854 | 6/1956 | Pederson | 104/172 R |

*Primary Examiner*—Kenneth W. Sprague
*Assistant Examiner*—James C. Yeung
*Attorney, Agent, or Firm*—Buell, Blenko & Ziesenheim

[57] ABSTRACT

A roller dryer for clay pipe comprised of a support means for transporting pipe through a tunnel dryer and roller carriage means for rotating the pipe to achieve uniform drying thereof. The roller dryer can accommodate pipes of different lengths and diameters while maintaining the lineality and concentricity of the pipe sections.

5 Claims, 8 Drawing Figures

ROLLER DRYER FOR CLAY PIPE

This invention relates to a roller dryer for clay pipe and particularly to a roller dryer for sanitary clay pipe having slip seal joints. The roller dryer of the present invention will greatly reduce the amount of floor space and manpower used in the drying of clay pipe. The reduction in the amount of floor space utilized and manpower involved, can reduce the production costs for clay pipe. The roller dryer of the present invention also reduces the amount of time necessary to cure the pipe. In addition to these advantages of economy and efficiency, the roller dryer of the present invention also reduces the number of pipe sections which are unuseable for the intended purpose due to deformation of shape caused by drying.

The use of clay pipe for water lines, effluent lines and the like is old and well known. Likewise, the method of manufacture of such pipe sections is an old art. During the manufacture of sanitary clay pipe, one of the last steps is the "curing step" in which the moisture content of the pipe material is reduced and shrinkage controlled to permit a final finishing and hardening of the pipe. It is general practice to cure these pipe sections by a batch method. In the batch method, the pipes are placed on end or in horizontal rows in a large heated drying room and permitted to dry for a number of hours. The drying room requires a considerable amount of floor space and the placement of pipe requires considerable manpower and time. The placing of pipe in a drying room for curing can effect a deformation in the shape of the pipe. The deformation in shape can result in the pipe being unuseable for its intended purpose and cause it to be sold at a discounted price. The loss cause by such sales is an additional economic drawback of the present methods of curing the pipe. Further expense is incurred by the time and manpower used to remove the cured pipe from the drying room before a new batch of pipe can be loaded.

Various apparatus employing rollers to carry the pipe through a tunnel dryer have been proposed. Most of these structures, however, include complicated drive structures for the rolls which greatly increase the cost of the apparatus, thereby reducing the economic benefit derived from the use of a roller dryer. Further, the complexity of the structure can detract from its operability in the contamination and heat of a dryer tunnel. Also, the complexity of the structure would greatly enlarge the amount of maintenance required by these apparatus compared to the apparatus of the present invention. This increased maintenance further detracts from the economic advantages of the prior art apparatus.

The present invention provides a novel and significant improvement over the present practices employed to cure clay pipe. The apparatus provides the means for the continuous curing of pipe while preserving the lineality and concentricity of the pipe.

In the foregoing general description, I have set out certain purposes, objects and advantages of my invention. It will be described hereafter and will become apparent for those skilled in the art of the manufacture of clay pipe when considering the following description and drawings in which.

Figure 1:
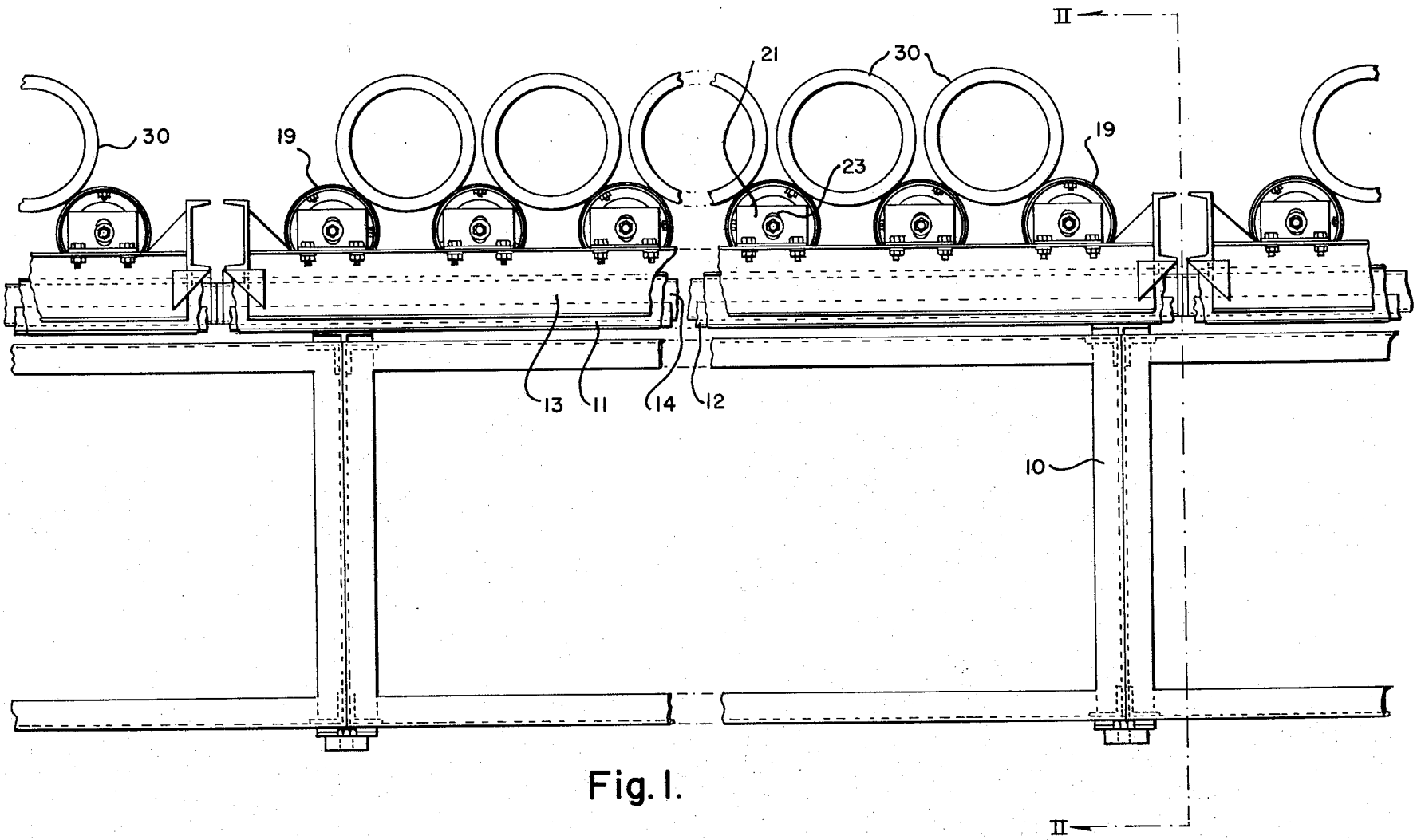
FIG. 1 is a fragmentary side elevational view of the roller dryer of the present invention.
Figure 2:
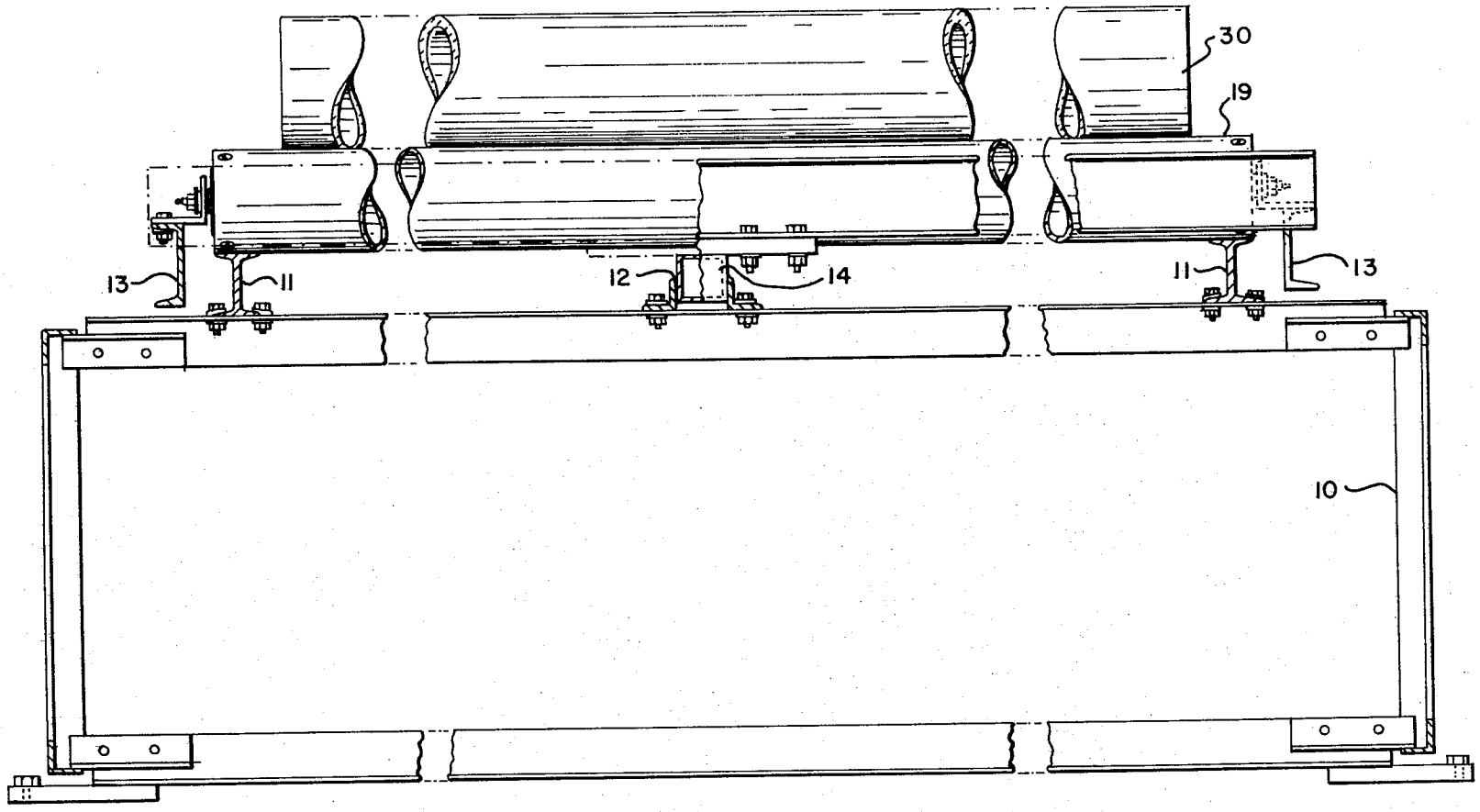
FIG. 2 is a transverse cross-sectional view taken on line II—II of FIG. 1.
Figure 4:
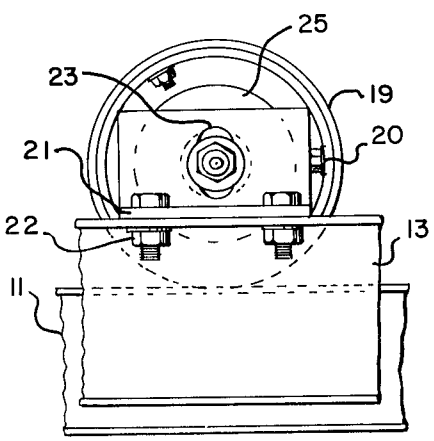
FIG. 4 is a detail end elevational view of a support roll.

FIG. 1 shows a support frame 10 made of structural steel or a like material. Mounted on support frame 10 are railings 11 which are attached to the members of the support frame by welds or bolts or other means well known in the art. Spaced between rails 11 is guide tube 12. Guide tube 12 is also attached to the members of support frame 10 by welds or bolts or other means well known in the art.

Figure 7:
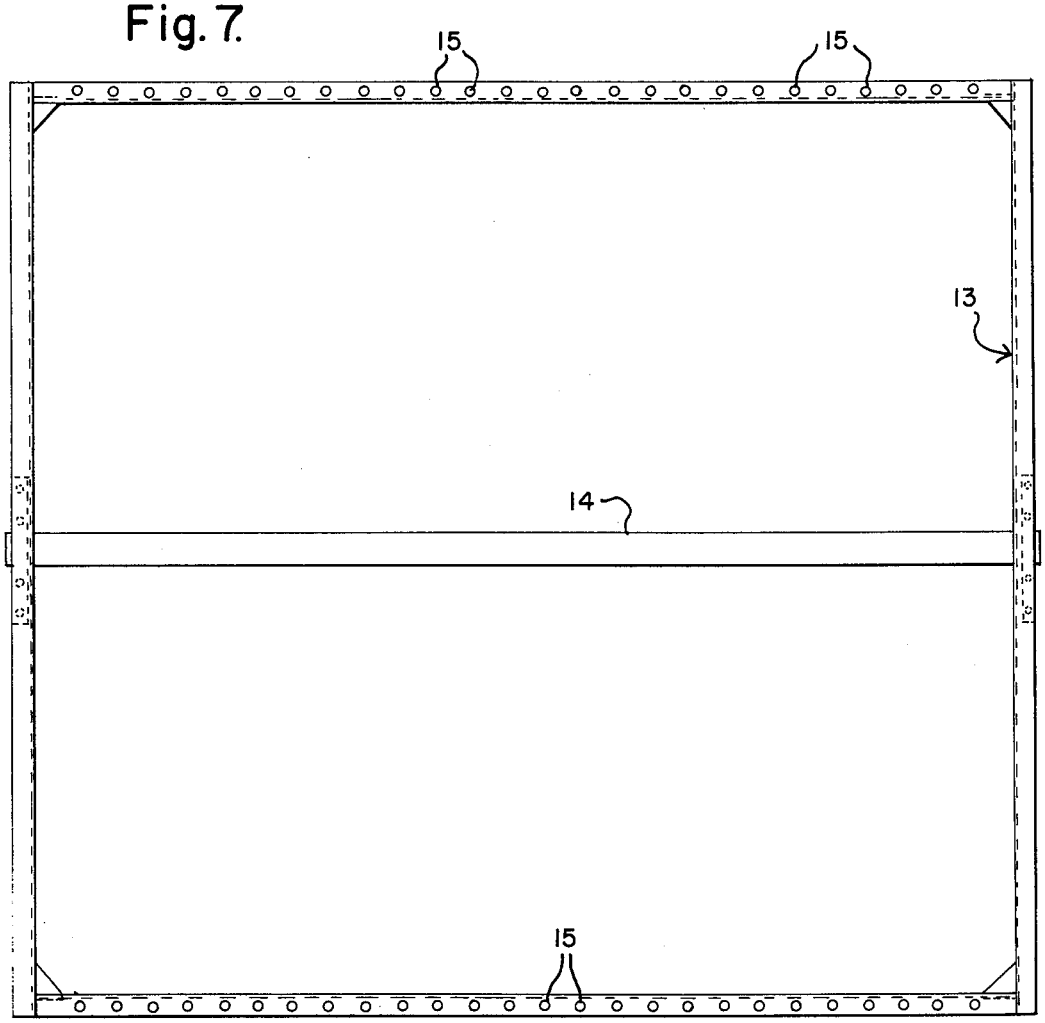
FIG. 7 is a top plan view of the roll carrier frame.

Roller carrier frame 13 (FIG. 7) is comprised of structural steel members and includes guide element 14 which slideably engages guide tube 12 of the support frame thereby positioning the roll carrier on the support frame. The carrier 13 contains a plurality of holes 15 which are provided to receive the bolts and the like which fasten the support roll members to the frame.

Figure 8:
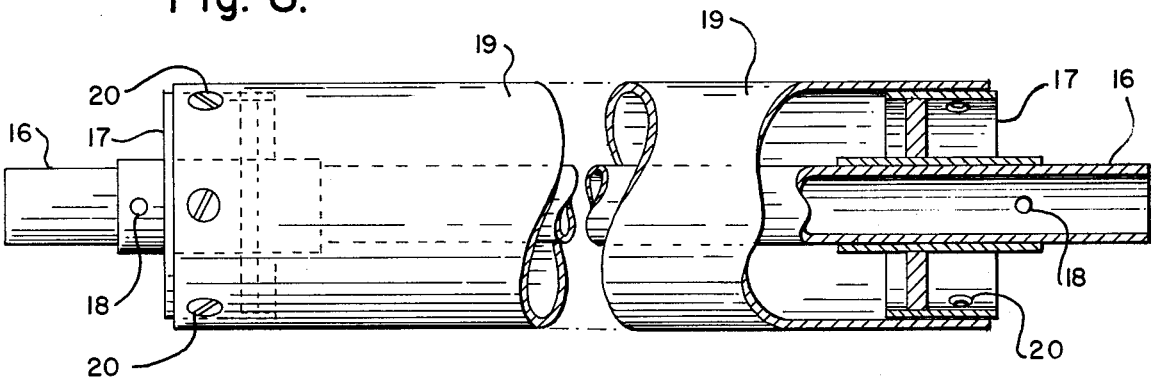
FIG. 8 is a fragmentary elevational view of a roll partially in section.

Referring to FIG. 8, the support rolls are comprised of a tubular shaft 16 having mounted thereon hub 17. Hub 17 is attached to each end of the shaft by means of fasteners 18. Hub 17 forms a circular hub to receive sleeve roll 19. Sleeve roll 19 is mounted on hub 17 by means of fasteners 20.

Figure 5:
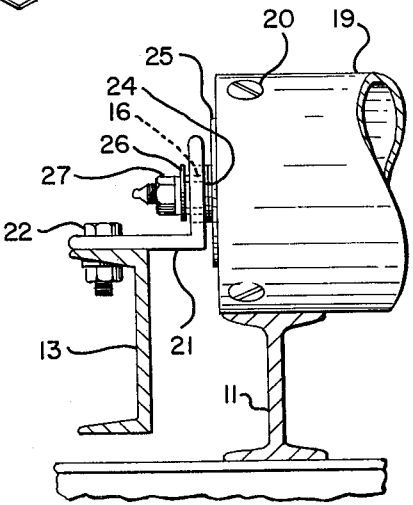
FIG. 5 is a fragmentary elevational view of the support roll shown in FIG. 4 as viewed from the left thereof.
Figure 3:
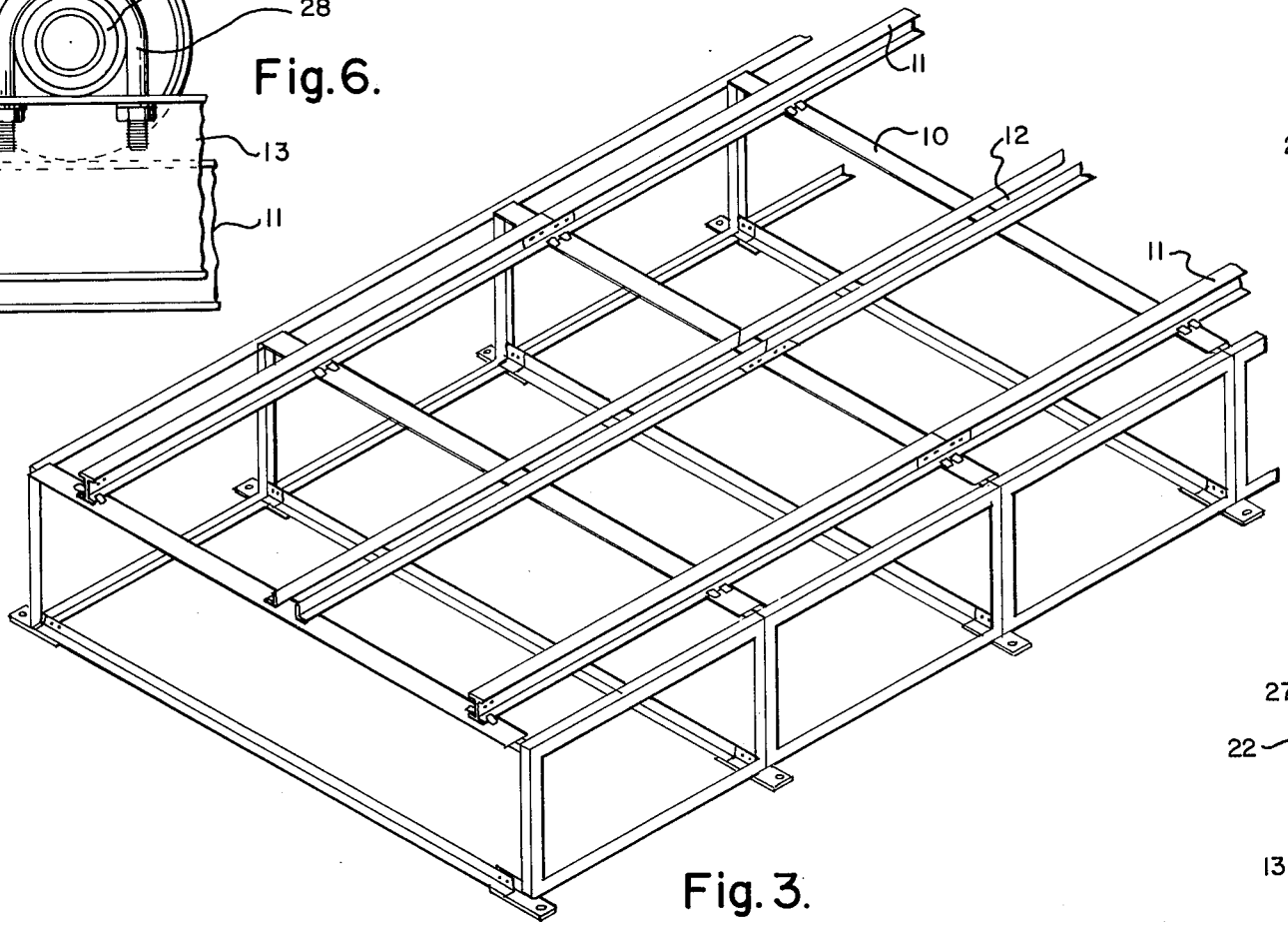
FIG. 3 is a partial isometric view of the support frame element of the present invention.
Figure 6:
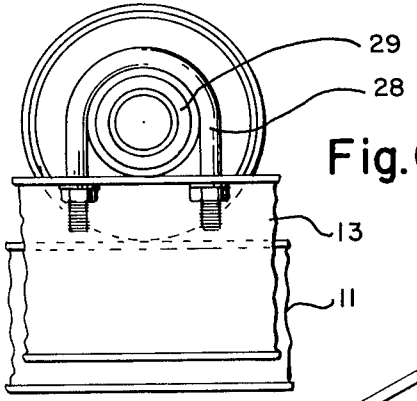
FIG. 6 is a detailed end elevational view of an alternate roll support.

The support rolls are operably attached to the roll carrier (FIG. 5). Support plate 21 is mounted on roll carrier frame 13 by means of fasteners 22 which are inserted in selected holes 15. Support plate 21 has a vertical slot 23 which is adapted to receive shaft 16 of the support roll. Bearing 24 is operably attached to the slot and shaft 16 to permit vertical movement of the shaft within the slot. Spacer means 25 and 26 are also mounted on the shaft to prevent lateral movement with relationship to the support frame. The end of shaft 16 which extends outwardly of slot 23 is threaded to receive fastener 27. The number of rolls which are attached to the carrier 13 is determined by the diameter of the pipe to be conveyed by the rollers. FIG. 6 shows an alternate fastening means wherein a U-bolt 28 having bearing 29 is utilized in the place of support plate 21. Axial movement in this embodiment is also prevented by the use of spacer means not shown and a fastening means, not shown. Each support roll attached to the frame is adapted to frictionally engage rails 11 of support frame 10.

In operation support frame 10 would be constructed the length of the tunnel dryer in which it was to be used. Support frame 10 could be constructed of continuous elements or in sections to permit variations in length. The pipe to be dried 30 is placed on the sleeves of rolls 19 which have been operably attached to roll carrier 13. As described, the rolls could be spaced to accomodate pipe of various diameter by reason of the plurality of holes 15 in carrier 13. In addition, the configuration of holes 15 could be altered so that pipes of extremely large or small diameters could be accomodated. Once the pipe had been loaded, a forklift or the like would be used to take the carrier to the tunnel dryer were the guide element 14 would be inserted in guide tube 12. The carrier would then be pushed by means such as hydraulic or mechanical means through the tunnel dryer. The sleeves of the rolls 19 would engage rails 11 of the support frame causing rotation of the rolls during their movement through the tunnel dryer. The rotation of the sleeve rolls 19 would cause rotation of pipe 30. The rotation of the pipe would cause an even distribution of the heat created by the heat source means located throughout the tunnel dryer. Once the roll carrier had reached the end of the tunnel, a forklift or other means could be used to remove it from the support frame 10. The pipe removed for further treatment and carrier 13 returned to the loading end of the tunnel to be reloaded with pipe and reused.

An alternative embodiment of the invention (not shown) would permit the support frames to be stacked vertically within the tunnel dryer. This could be accomplished by building a support frame work of structural metal to accomodate a vertical series of frames and roll carriers. Where the space provided by the tunnel dryer were sufficient, this could provide additional economies in the utilization of the tunnel dryer. Likewise, where short length pipes were being dried, the support frames and carriers could be used side-by-side within a single tunnel.

By use of the roller dryer of the present invention, pipe of various lengths and diameters can be dried efficiently and economically while the quality of the finished product is enhanced.

In the foregoing specification, I have set out certain preferred embodiments of my invention, however, it will be understood that this invention may be otherwise embodied within the scope of the following claims.

I claim:

1. In a tunnel dryer having a plurality of rails extending therethrough, the improvement which comprises:
   (a) a rectilinear frame which extends transversely across at least some of said rails, a plurality of roll mounting positions along opposite sides thereof extending parallel to said rails,
   (b) a plurality of opposed roll support means,
   (c) a plurality of roll members extending between opposed roll support means while resting upon at least some of the rails, and
   (d) means selectively positioning said opposed roll support means at selected roll mounting positions whereby the distance between said roll member may be varied.

2. The apparatus of claim 1 in which there are guide means in cooperating connection between the frame and the tunnel dryer for guidance of the frame through the tunnel dryer.

3. The apparatus of claim 1 in which the roll mounting positions comprise a plurality of mounting holes formed on the side members of the frame.

4. The apparatus of claim 3 in which the roll support means are positioned relative to the frame by a plurality of U-bolts extending through the mounting holes.

5. The apparatus of claim 2 in which the guide means comprises a bracket extending downwardly from the frame and engaging a cooperating member in the tunnel dryer extending parallel to the rails.

* * * * *

UNITED STATES PATENT OFFICE

CERTIFICATE OF CORRECTION

Patent No. 4,083,119 Dated April 11, 1978

Inventor(s) Stephen B. Yacura

It is certified that error appears in the above-identified patent and that said Letters Patent are hereby corrected as shown below:

Column 2, line 63, "accomodate" should be --accommodate--.

Column 2, line 67, "accomodate" should be --accommodate--.

Column 2, line 68, "had" should be --has--.

Column 3, line 1, "were" should be --where--.

Column 3, line 21, "accomodate" should be --accommodate--.

Signed and Sealed this

*Third* Day of *October 1978*

[SEAL]

*Attest:*

RUTH C. MASON
*Attesting Officer*

DONALD W. BANNER
*Commissioner of Patents and Trademarks*